United States Patent [19]

Wright

[11] Patent Number: 4,553,673

[45] Date of Patent: Nov. 19, 1985

[54] METHOD AND APPARATUS FOR OBTAINING UNDERCUTS OF CONCENTRATES FROM PULP FLOW IN SPIRAL SEPARATORS

[75] Inventor: Douglas C. Wright, Terranora, Australia

[73] Assignee: Mineral Deposits Ltd., Queensland, Australia

[21] Appl. No.: 438,590

[22] Filed: Nov. 2, 1982

[51] Int. Cl.[4] ..... B03B 11/00; B03B 5/52

[52] U.S. Cl. ..... 209/697; 209/459; 209/493; 209/494

[58] Field of Search ..... 209/696, 697, 458, 459, 209/493, 494, 495, 506, 211

[56] References Cited

U.S. PATENT DOCUMENTS 2,431,560 11/1947 Humphreys ..... 209/459 X 4,189,378 2/1980 Wright et al. ..... 209/459

*Primary Examiner*—Robert B. Reeves

*Assistant Examiner*—Edward M. Wacyra

*Attorney, Agent, or Firm*—Stevens, Davis, Miller & Mosher

[57] ABSTRACT

This invention relates to a take-off assembly for mounting in a spiral separator. The take-off assembly includes an adjustment tongue and a mating member containing a transverse aperture for receiving the adjustment tongue. The mounting member has a surface surrounding the adjustment tongue which is substantially flush with the top surface of the adjustment tongue. There is also provided an undercut for obtaining an undercut of concentrates particles from pulp flowing in the spiral separator whereby tailings and/or middlings contained in an upper portion of the pulp above the concentrates particles may flow across the transverse aperture.

There is also provided a spiral separator for gravity separation of minerals containing the take-off assembly and a method of taking undercuts including using the abovementioned take-off assembly in the spiral separator.

1 Claim, 6 Drawing Figures

METHOD AND APPARATUS FOR OBTAINING UNDERCUTS OF CONCENTRATES FROM PULP FLOW IN SPIRAL SEPARATORS

This application is a continuation-in-part of application Ser. No. 336,437, filed Dec. 31, 1981, and now abandoned.

This invention relates to a take-off assembly suitable for mounting in a spiral separator. The take-off assembly is primarily adapted to separate particles of different density contained in a pulp of water and particles fed to the spiral separator. The spiral separator treats the pulp so as to isolate the valuable mineral particles therefrom by a process of gravitational separation.

U.S. Pat. No. 4, 189,378 describes a spiral separator having a take-off assembly wherein the take-off assembly includes a slot in the bottom portion of the spiral separator which is oriented in a direction transverse to the flow of pulp. A tongue is slidably mounted in the slot whereby the tongue may be advanced or retracted to vary the clearance between an inner end of the slot and a proximal end of the tongue.

Disadvantages associated with the arrangement described above have been found to exist in relation to efficient separation of middlings (ie particles of density which is intermediate that of the mineral rich concentrates and the tailings) from the concentrates. Thus the separation of middlings from concentrates was found to be relatively unsatisfactory because of the difficulty in obtaining undercuts of concentrates from the pulp. If such undercuts could not be carried out efficiently the concentrates tended to combine with the overlying silica particles in flowing across the slot to combine with the remainder of the tailings.

It is therefore an object of the present invention to provide a take-off assembly which alleviates the problem referred to above.

The invention in one aspect therefore provides a take-off assembly suitable for use in a spiral separator including a throat gap adjustment member, a mounting member containing a transverse slot or aperture for receiving the throat gap adjustment member; and means for obtaining an undercut of concentrate particles from pulp fed to the spiral separator whereby tailings and/or middlings contained in an upper portion of the pulp above the concentrate particles may flow across the transverse slot or aperture.

Preferably the throat gap adjustment member is elongate and is a tongue which is slidably mounted in the mounting member which also may be elongate. The mounting member is suitably plate-like having a centrally located slot of complementary shape to that of the tongue. The slot and tongue are suitably rectangular having a pair of opposed side portions and a pair of opposed end portions. The centrally located slot may also be provided with mounting grooves or ribs in the side portions thereof for mounting of the tongue which may be provided with ribs or grooves of complementary shape to that of the slot.

The undercut means described above in one form may comprise one or more peripheral notches or slots in the side portion(s) or end portion(s) of the tongue. Preferably however the undercut means is a single peripheral notch or slot located in a side portion of the tongue adjacent an end portion thereof which is proximal to an inner end of the transverse slot.

In another form the undercut means may comprise the tongue being formed into two or even three components which are all slidably attached to each other. Selective movement of one component relative to the other component(s) may provide an undercut slot or aperture for achieving an undercut of concentrates which concentrates may have a top layer of middlings and/or tailings and thereby allow the top layer of middlings and/or tailings to flow across the take-off assembly so that they may be separated from the concentrates.

It will be noted in U.S. Pat. No. 4,189,378 that there is disclosed therein tongue comprising a centrally located slot (numbered 27 in the drawings) in which there is engaged an adjustable slide (number 28 in the drawings). The tongue of U.S. Pat. No. 4,189,378 however is provided with an upright splitter blade (number 24 in the drawings) and it has now been found that such splitter blade is detrimental to efficient taking of undercuts from the pulp because it has a tendency to cause the pulp to be diverted from flowing across the region of the transverse slot where an undercut is required to be taken.

An additional problem with reference to U.S. Pat. No. 4,189,378 was that the tongue described therein was bridged by the splitter blade and thus efficient taking of undercuts was not possible because of the presence of the bridging splitter blade. Thus it was not possible to readily calculate a desired setting of the tongue relative to the inner end of the slot so that undercuts could be taken at the most appropriate location.

A still further problem with U.S. Pat. No. 4,189,378 was that often the concentrate particles located below the overlying tailings or silica had a tendency to "jump" the transverse slot and thus end up with the tailings or silica and thus undercuts could not be satisfactorily carried out.

Yet another problem with U.S. Pat. No. 4,189,378 was that the leading end or upstream portion of the splitter blade caused a build up of "trash" and thus sand-barring of pulp would occur within the region of the leading end or upstream portion of the splitter blade.

Thus in relation to the present invention it is a necessary limitation for the effective taking of undercuts that a top surface of the tongue is substantially flush with the top surface or surrounding surface of the mounting member.

The invention also includes within its scope a spiral separator incorporating the abovementioned take-off assembly.

It is also within the scope of the invention that the mounting member be omitted and the transverse slot or aperture be formed in the bottom wall of the continous helical trough forming the spiral separator. In this embodiment the tongue may be mounted directly in the slot or aperture.

The invention may also include within its scope a method of taking undercuts including the steps of;

(i) feeding a pulp of mineral particles and water to a top part of a spiral separator comprising a continous helical trough wherein said trough includes a take-off assembly as hereinbefore described; and (ii) taking an undercut of concentrate particles from said pulp as said pulp flows across the take-off assembly to separate said concentrate particles from on overlying layer of tailings and/or middlings which may flow past the take-off assembly with the pulp.

Reference may now be made to preferred embodiment of the invention as shown in the accompanying drawings wherein.

Figure 1:
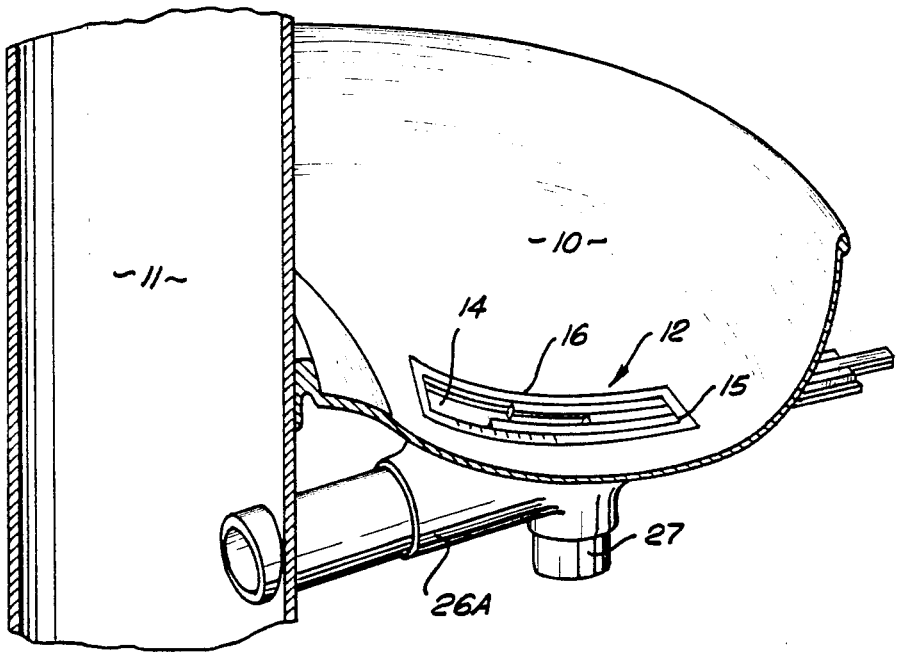
FIG. 1 illustrates a perspective view of a spiral separator constructed in accordance with the invention.
Figure 3:
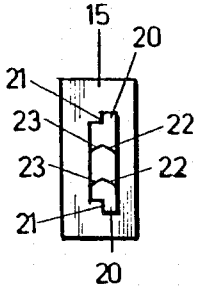
FIG. 3 illustrates an end view of the take-off assembly shown in FIG. 2.
Figure 2:
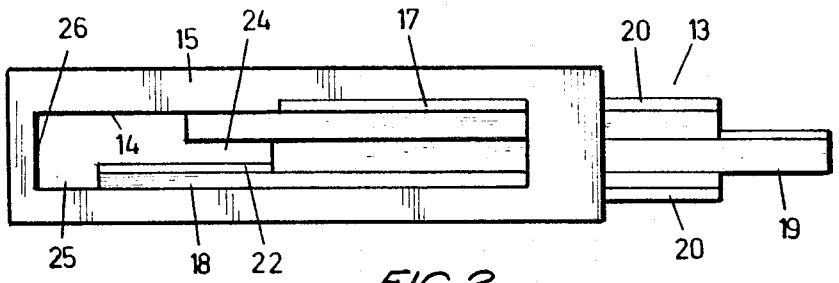
FIG. 2 illustrates a top plan view of a take-off assembly for use with the spiral separator of FIG. 1.
Figure 5:
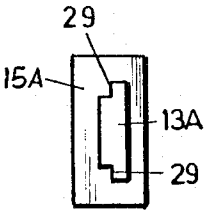
FIG. 5 illustrates an end view of the take-off assembly shown in FIG. 4.

The spiral separator shown in the drawings includes a continous helical trough 10 having an upright column 11. There is provided in trough 10 a take-off assembly 12 having a tongue 13 slidably mounted in a transverse slot 14 provided in a mounting plate 15. Mounting plate 15 may be fixedly mounted in an accommodating slot 16 in trough 10 by use of adhesive if desired. Alternatively mounting plate 15 may be releasably mounted in slot 16. Tongue 13 includes three components which are end components 17 and 18 and intermediate component 19. End components 17 and 18 include mounting ribs 20 slidably engagable in corresponding grooves 21 provided in mounting plate 15. Component 19 includes side ribs 22 slidably mounted in mating grooves 23 of components 17 and 18.

In operation of the take-off assembly 12 component 19 of tongue 13 is retracted with respect to component 17 and 18 as shown to provide a gap 24 between components 17 and 18. There is also shown aperture 25 provided by partial withdrawal of tongue 13 from abutting inner end 26 of slot 14. Gap 24 allows for an undercut of pulp to be taken as pulp flows across slot 14. Aperture 25 allows for the taking of a side cut of high grade concentrate particles. The undercut taken through gap 24 is of high grade concentrate particles and allows for silica overlying the undercut to flow across slot 14 and be combined with the tailings.

The setting of component 17 in slot 14 may be determined experimentally so as to obtain the most efficient recovery of mineral concentrate taken through aperture 25. In some cases component 19 may be retracted so as to have the same setting of component 17 depending upon the depth of the mineral concentrate being recovered and/or the velocity of pulp.

The undercut and sidecut of high grade concentrate that may be taken may be collected in conduit 26A for transfer to hollow column 11. There also may be provided a middlings conduit 27 if desired. However conduit 27 may be dispensed with if required.

Figure 4:
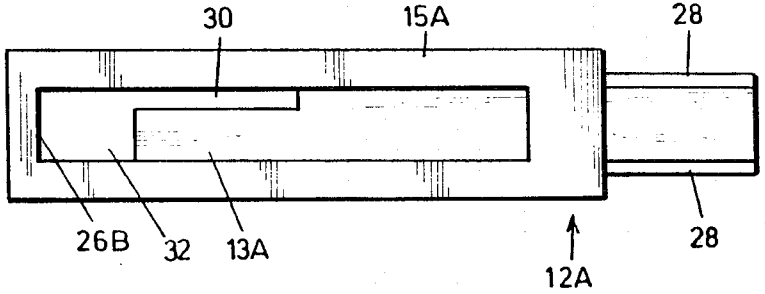
FIG. 4 illustrates a modified form of take-off assembly to that shown in FIG. 2.

The modified take-off assembly 12A shown in FIG. 4 includes mounting plate 15A and tongue 13A slidably mounted therein. Tongue 13A includes ribs 28 for engagement with accommodating grooves 29 included in plate 15A. Tongue 13A may include peripheral notch 30. Tongue 13A is also partially retracted from inner end 26B of mounting plate 15 to provide clearance for aperture 32 which has the same function of aperture 25 described previously. Notch 30 has the same function as gap 24 described previously.

Figure 6:
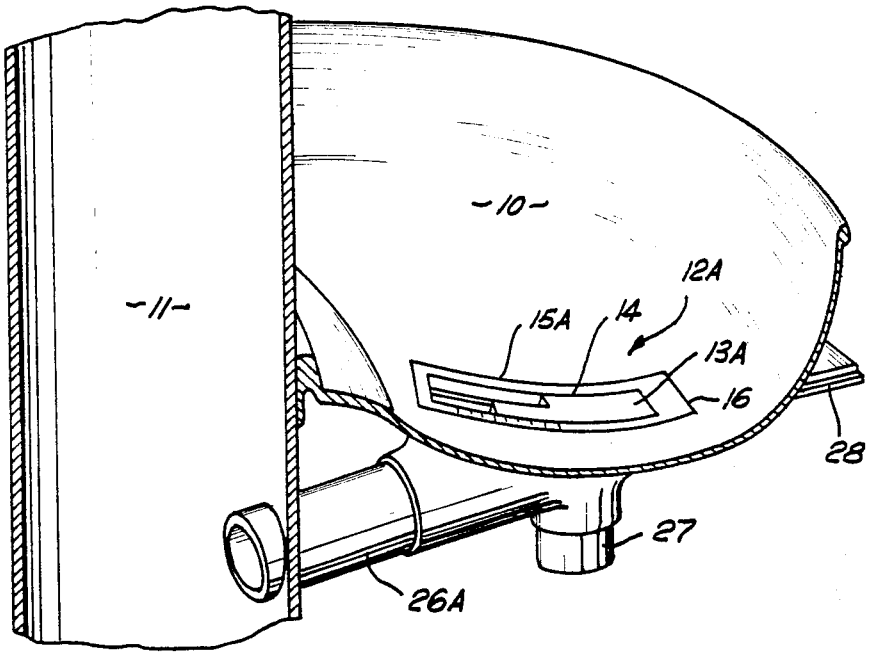
FIG. 6 illustrates a perspective view of a spiral separator incorporating the take-off assembly shown in FIG. 4.

The spiral separator shown in FIG. 6 has like reference numerals as described above in relation to FIG. 1 and suitably accommodates take-off assembly 12A as shown.

The number of take-off assemblies that may be mounted in a single separator are dependent on the type of pulp being processed, the speed of flow of the pulp and its depth. If there is heavy mineral content in the feed then several take-off assemblies may be required.

Usually the concentrate particles separate out into a visible concentrate band and an invisible concentrate band which may have overlying layer of silica particles. The invisible concentrate band when taken as undercuts as described above considerably improves the efficiency of separation and collection of concentrates (and/or middlings) from the pulp as described above.

It is also within the scope of the invention that instead of adjustment tongue 13 or 13A being slidably mounted in slot 16 or slot 14 that adjustment tongue 13 or 13A be fixedly mounted (eg. by use of adhesive) in its mating slot after suitable experimentation has taken place so as to provide the most appropriate setting for obtaining maximum recovery of concentrates.

If desired intermediate component 19 may be fixedly attached to components 17 and 18 after an appropriate setting has been determined.

I claim:

1. A take-off assembly for a spiral separator having a trough through which the particles to be separated flow, a mounting member defining a transversely extending substantially rectangular opening adapted to be mounted within said trough, with the upper surface of said opening being substantially flush with the trough lower surface, and tongue means comprising a single member slidably supported in said mounting member for occluding a portion of said opening, said tongue having a peripheral notch at an upstream edge to define a first concentrate opening of a width substantially less than the width of said mounting member, said tongue being retractable transversely from said mounting member so as to form a second concentrate opening of a width substantially equal to the width of said mounting member, said second concentrate opening being adjacent said first concentrate opening, said tongue means having no portion thereof extending above said mounting member opening.

* * * * *